United States Patent [19]

Shields

[11] Patent Number: 5,035,291

[45] Date of Patent: Jul. 30, 1991

[54] SEAFLOOR DRILLING APPARATUS

[75] Inventor: Roger G. Shields, Dewinton, Canada

[73] Assignee: Amoco Corporation, Chicago, Ill.

[21] Appl. No.: 548,786

[22] Filed: Jul. 6, 1990

[51] Int. Cl.[5] ..... E21B 7/12; E21B 7/124

[52] U.S. Cl. ..... 175/5; 175/6

[58] Field of Search ..... 175/5, 6, 7, 8, 9, 10, 175/310, 334, 335, 385, 388

[56] References Cited

U.S. PATENT DOCUMENTS 3,707,196 12/1972 Veiville ..... 175/5

4,304,309 12/1981 Fercho et al. ..... 175/215 X

*Primary Examiner*—William P. Neuder

*Attorney, Agent, or Firm*—Scott H. Brown; Fred E. Hook

[57] ABSTRACT

Apparatus for drilling a large diameter hole in the surface of a material includes an upper body; a lower body rotatably connected to the upper body; a motor for rotating the lower body relative to the upper body; cutting discs, connected to the lower body for cutting the material and moving the material toward a casing; the casing, extending through the upper and lower bodies, for receiving the cuttings from the cutting disk and carrying the cuttings through the bodies; and an engagement assembly for limiting downward travel of the casing and the bodies so that the casing is securable in a preselected position of downward travel and is removable through the upper side of the upper body. The engagement assembly engages the casing with the lower body so that the casing is rotated with the lower body. An auger having a hollow interior can be provided at the lower end of the casing. The casing and auger can be removed through the top of the apparatus and a conventional drill string and drill bit can be passed therethrough.

11 Claims, 5 Drawing Sheets

SEAFLOOR DRILLING APPARATUS

BACKGROUND OF THE INVENTION

1. Field of the Invention

This invention relates to an apparatus for creating, as by drilling, a hole in the earth, and more particularly, but not by way of limitation, to such an appparatus for drilling large diameter holes in the sea floor for receiving subsea equipment.

2. Setting of the Invention

Large diameter holes (e.g., greater than about 2 meters in diameter) are created in the sea floor to protect underwater blow-out preventers, Christmas trees, valving, etc., used with underwater oil and gas wells in ice-infested waters, shipping lanes, fishing areas, etc.; for the installation of large diameter construction piles on land and underwater in inland waters and offshore; offshore mining for minerals; for vent and production shafts in mining for tar sands, oil shale, coal, potash, and other minerals; recovering mine tailings from tailing ponds; and in habor benching. These large diameter holes are created by specialized drilling apparatus, such as described in U.S. Pat. No. 4,304,309. The apparatus of U.S. Pat. No. '309 includes a normally fixed upper section and a lower section rotatably mounted on the bottom of the upper section. Drive mechanisms rotate the lower section relative to the upper section. Disc cutters are rotatably mounted on the base of the lower section for cutting and moving material in an earth formation beneath the apparatus, and for directing the cut material towards the bottom center of the base of the lower sections. A transfer pipe mounted in the base of the lower section receives the cut material and feeds the cut material into a central discharge pipe, mounted in and extending upwardly from the upper section and in fluid communication with the transfer pipe.

In the past, if a drill bit and drillstring were to be used to drill or core the subterranean formations while the large diameter hole was being drilled, the drilling apparatus would first have to be raised and stowed. Further, in the event that cuttings, gravel, rocks, and the like blocked or clogged the central cuttings removal system of the apparatus, the entire drilling apparatus would have to be raised to clean out the cuttings removal system. There is a need for a large diameter drilling apparatus that can be used, have access into, and be cleaned without having to raise the entire drilling apparatus.

SUMMARY OF THE INVENTION

The present invention is contemplated to overcome the forgoing deficiencies and meet the above described needs. For accomplishing this, the present invention provides a novel and improved apparatus for drilling a hole in the surface of a material, such as the surface of the earth.

The present invention is a sea floor drilling apparatus which includes an upper body, a lower body, rotator mechanisms, cutting mechanisms, and engagement mechanisms. The upper body has an opening extending through the upper body from an upper side to a lower side. The lower body is rotatably connected to the upper body and has an opening extending through the lower body from and upper side to a lower side in such a manner that the upper body opening and the lower body opening provide a continuous shaft through the upper and lower bodies. The rotator mechanisms rotate the lower body relative to the upper body. The cutting mechanisms are connected to the lower body for cutting the material and moving the cuttings toward the lower body opening. A casing extends through the shaft for receiving the cuttings from the cutting mechanisms and for carrying the cuttings through the shaft. The engagement mechanisms limit downward travel of the casing in the shaft so that the casing is securable in a preselected position of downward travel in the shaft and is removable from the shaft through the upper side of the upper body. The engagement mechanism also engages the casing with the lower body so that the casing is rotated with the lower body by the rotator mechanisms.

The casing includes an upper casing and a lower casing that extends below the lower side of the lower body and includes at least one port for admitting cuttings into the casing. A receptacle is connected to the lower end of the lower casing below the port for catching the cuttings which enter the lower casing and which are not transported out of the casing. Preferably, the receptacle is formed by an auger having an interior cavity open to the interior of the casing. A drill bit can be connected to the lower end of the auger.

The present invention permits the casing to be removed and a drill string run through the center of the apparatus while the apparatus remains in position on the sea floor. Thus, the rock and other debris can be easily cleaned out on the surface on the vessel, saving time and operating costs.

DETAILED DESCRIPTION OF THE PREFERRED EMBODIMENT

Figure 1:
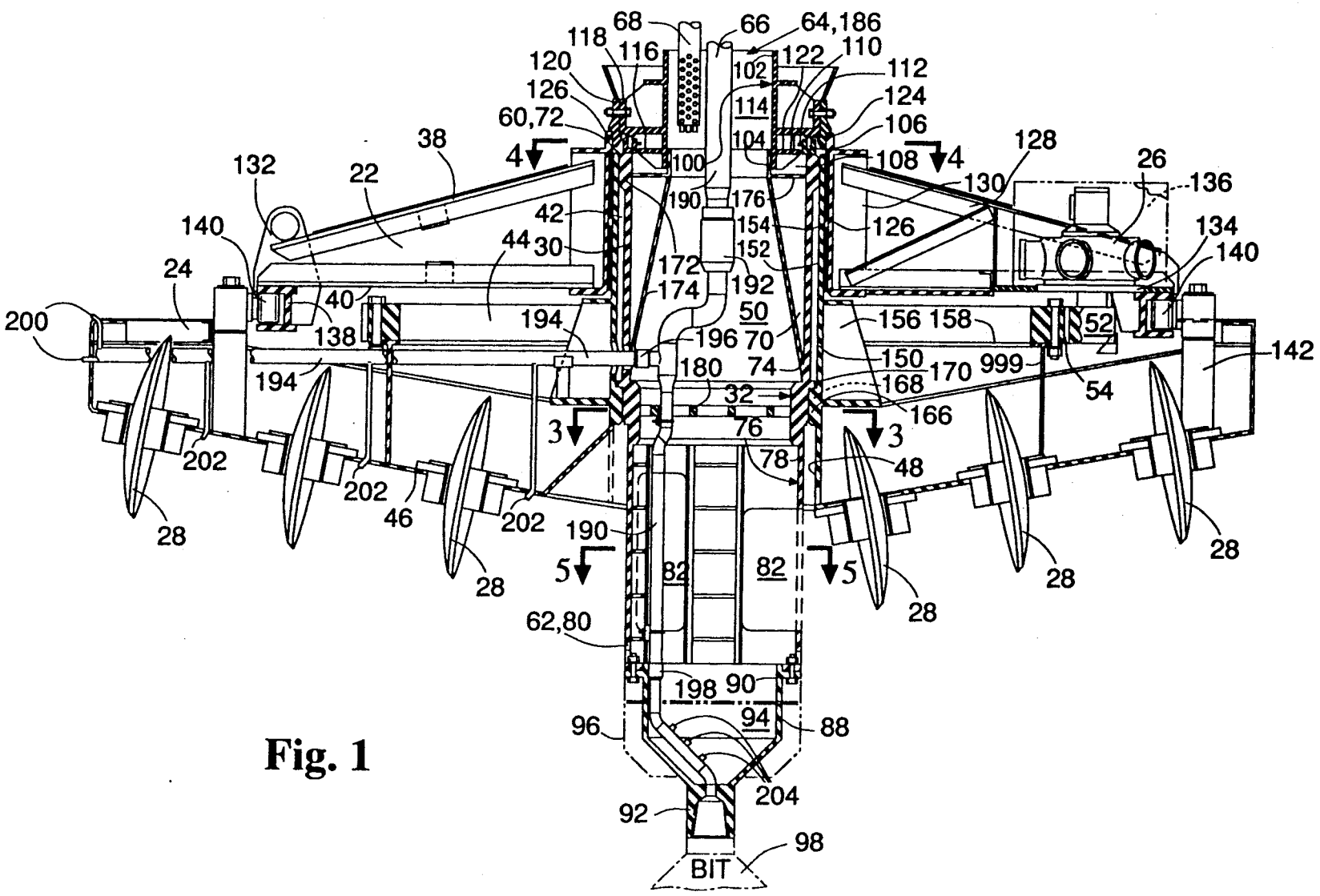
FIG. 1 is a cross-sectional view of an embodiment of the drilling apparatus for the present invention.

FIG. 1 presents an embodiment of the apparatus, generally designated 20, for drilling a hole in the surface of a material, such as the surface of the earth. Referring to the example of FIG. 1, the apparatus 20 can be generally described as comprising an upper body 22, a lower body 24, rotator mechanism 26, cutting mechanisms 28, a tubular member or casing 30, and engagement mechanisms 32.

The upper body 22 has an upper side 38, a lower side 40, and an opening 42 extending through the upper body 22 from the upper side 38 to the lower side 40. The lower body 24 is rotatably connected to the upper body 22 and has an upper side 44, a lower side 46, and an opening 48 extending through the lower body 24 from the upper side 44 to the lower side 46. The lower body opening 48 passes through the lower body 24 in such a manner that the upper body opening 42 and the lower body opening 48 provide a continuous shaft 50 through the upper an lower bodies 22, 24. In the preferred embodiment, the shaft 50 defines the axis of rotation of the lower body 24 relative to the upper body 22.

The rotator mechanism 26 is used for rotating the lower body 24 relative to the upper body 22. In the preferred embodiment, referring to the example of FIG. 1, the rotator mechanism is one or more electric or hydraulic motors, also designated 26, which rotates pinion 52 to drive ring gear 54 in order to rotate the lower body 24 relative to the upper body 22, as further discussed below.

The cutting mechanisms 28 in the general form of curved discs are rotatably connected to the lower body 24 for cutting the material and moving the cuttings toward the lower body opening 48.

The casing 30 extends through the shaft 50 and has an upper end 60 adjacent to the upper side 38 of the upper body 22 and a lower end 62 adjacent the lower side 46 of the lower body 24. The casing is used for receiving the earthen cuttings from the cutting means 28 and carrying the cuttings through the shaft 50. The cuttings travel from the lower end 62 of the casing 30 through the upper end 60, as further discussed below.

The engagement mechanism 32 is used for limiting downward travel of the casing 30 in the shaft 50 so that the casing 30 is securable in a preselected position of downward travel and so that the casing 30 is removable from the shaft 50 from the upper side 38 of the upper body 22. The engagement mechanism 32 is also used for engaging the casing 30 with the lower body 24 so that the casing 30 is rotated with the lower body 24 by the rotator mechanisms 26.

Referring to the example of FIG. 1, in the preferred embodiment, the apparatus 20 also includes a disposal mechanism 64 for disposing of the cuttings carried through the casing 30, fluid injection mechanism 66 for fluidizing the cuttings, and mobile mechanism 68 for moving the fluidized cuttings through the casing 30 and into the disposal mechanism 64, as will be further discussed below.

The casing 30 includes an upper casing 70 having and upper end 72 and a lower end 74 and a lower casing 76 having an upper end 78 connected to the upper casing lower end 74, a lower end 80. The casing 30 also includes at least one port 82 for admitting cuttings into the casing 30. Preferably, the lower end 80 of the lower casing 76 extends below the lower side 46 of the lower body and the port 82 is in the portion of the lower casing 76 below the lower body lower side 46. More preferably, the port 82 extends radially through the sidewall of the lower casing 76 in order to face into the direction of the incoming cuttings.

Referring to FIG. 1, in the preferred embodiment, a receptacle 88 is connected to the lower casing's lower end 80 for catching the earthen cuttings which enter the lower casing and which are not transported out of the casing 30. The receptacle 88 is preferably connected to the lower casing 76 below the port 82 in order to catch rocks and other debris which are too large or heavy to pass upwardly through the shaft 50 and casing 30.

More preferably, the receptacle 88 is an auger, also designated 88, having an upper end 90 connected to the lower casing lower end 80, a lower end 92, and an interior cavity 94 open to the shaft 50, i.e., the interior of the casing 30, and threads 96 on the outside surface of the auger 88. The auger 88 assists in guiding and stabilizing the apparatus 20 as it drills into the earthen formation. The auger 88 also pulls the apparatus 20 and cutting mechanism 28 into the earthen formation. A drill bit 98, preferably a tricone drill bit, can be connected to the lower end 92 of the auger 88 to assist the auger in piloting, guiding, and stabilizing the apparatus 20.

The preferred apparatus 20 includes a riser connector 100 which has an upper end 102 and a lower end 104. The lower end 104 is connected to the upper body 22 to block the casing 30 in the shaft 50. The casing 30 includes at least one roller 106 which extends upwardly loading between the casing 30 the riser connector 100 and for reducing friction between the rotating casing 30 and the riser connector 100. The roller 106 contacts the riser connector 100 when the casing 30 is subjected to an upward loading which moves casing 30 upward and moves the roller 106 into contact with the riser connector 100.

Preferably, the riser connector 100 is detachably connected to the upper body 22, i.e., the riser connector 100 can be disconnected from the upper body 22 from outside the upper body to allow access to the casing 30 and shaft 50. In the preferred embodiment, the riser connector 100 includes suspension mechanism 108 for suspending the casing 30 from the riser connector 100. The suspension mechanism 108 is created by a shoulder 110 which is connected to the riser connector 100 and extends radially into the shaft 50, and a catch 112 which is connected to the casing upper end 60 and extends radially in the shaft 50 in an opposing direction to the shoulder 110 and above the shoulder 110 so that the catch 112 will suspend the casing 30 from the shoulder 112 of the riser connector 100.

The riser connector 100 provides a means for lifting the casing 30 from the drilling apparatus 20; means for retaining or holding the casing 30 in the shaft 50 of the apparatus 20; means for rotating the upper body 22, e.g., if the riser connector 100 is connector to the drillstring or riser pipe of a drilling rig or other source of rotation; and a means for transferring loading forces to and from the apparatus 20. The prototype riser connector 100 includes a passeway 114, extending through the upper end 102 and the lower end 104 of the riser connector 100, which is preferably of smaller diameter than the internal diameter of the casing 30.

In the prototype riser connector 100, the passageway 114 is formed of a section of pipe and is concentrically positioned in the shaft 50 by radial flanges which extend from the outside surface of the passageway 114. An intermediate flange 116 extends to a diameter approximately equal to the internal diameter of the upper end of opening 42. The outer end of the circular intermediate flange 116 supports an axially extending circular flange 118. The outside diameter of the axial flange 118 is sized to fit within the internal diameter of an upper body collar 120 which surrounds the shaft 50 and extends from the upper side 38 of the upper body 22. In the preferred embodiment, the axial flange 118 is bolted to the collar 120, although equivalent forms of releasably fastening can be used. The collar 120 and flange 118 are designed to allow access to the bolts from the outside of the upper body 22 so that the riser connector 100 may be easily disconnected from the apparatus 20.

Lower flange 122 extends radially from near the lower end 104 of the riser connector 100. The lower flange 122 has a smaller outer diameter than the internal diameter of casing 30. The outer end of the preferably circular lower flange 122 provides the shoulder 110 from which the casing 30 is suspended. A circular roller track 124 is connected to the lower side of the intermediate flange 116. The lower track 124 provides a surface on which the rollers 106 can roll and can also be used to adjust tolerances in the apparatus 20, as further discussed below.

Upper body collar 120 is connected to the upper end of the upper body sleeve 126. Preferably, collar 120 is welded to the upper body sleeve 126, although equivalent fastening can be used. The upper body sleeve 126 defines the opening 42 in the upper body 22. Preferably, the upper body sleeve 126 is circular in cross-section. The upper body sleeve 126 transmits horizontal and vertical force loadings from the upper body 22, cutting mechanisms 28, casing 30, auger 88, and drill bit 98 through the upper body collar 120 to the riser connector 100. It should be noted that casing 30 can move axially relative to collar 120, rollers 106 contact the track 124.

Figure 2:
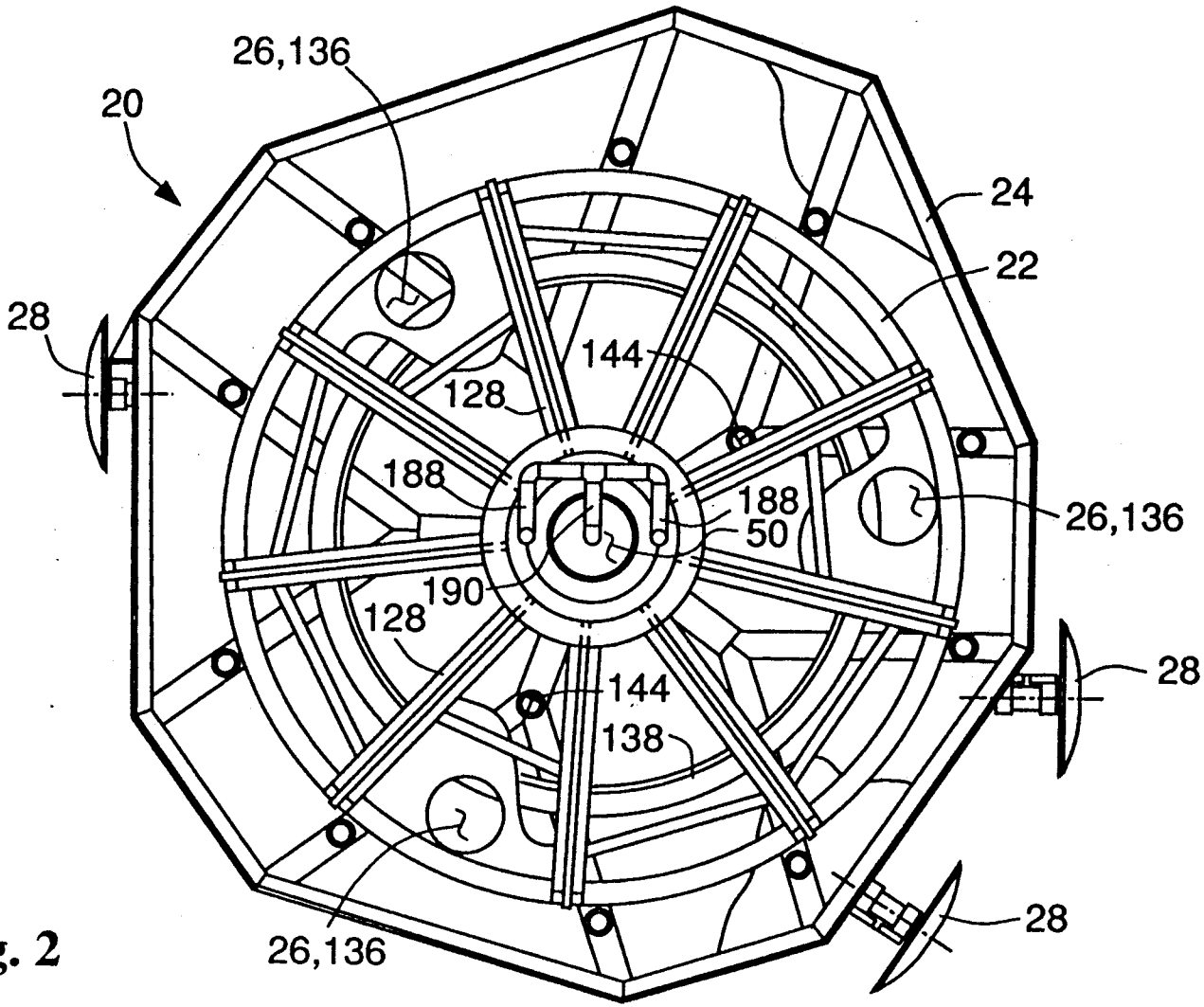
FIG. 2 is a top plan view of FIG. 1.

The upper body 22 is comprised of a series of angle iron trusses 128 which extend radially from the upper body sleeve 126. The trusses 128 are connected to ribs 130 which extend radially from and axially along the length of the outside of the upper body sleeve 126. Lifting eyes 132 are connected to the outer ends of the trusses 128 and are used for lifting and lowering the apparatus 20. Motor mounts 134 are connected to the outer ends of trusses 128. In the prototype apparatus 20, there are three motor mounts 134 and three motors 26. The motor mounts 134 both support the motors and provide a bearing plate for the drive pinions 52. Referring to FIG. 2, preferably the motors 26 are spaced equidistantly around the upper body 22. Preferably, the motors 26 are waterproof, either integrally, or can be provided with motor covers 136 to protect from water and from the potentially damaging operating environment. In the prototype apparatus 20, the motors 26 are hydraulic motors and therefore each requires a hydraulic supply line, return line, and case drain line (not illustrated). In the prototype, these lines are provided via a piping manifold (not illustrated) which is accessible from the upper side of the upper body 22.

The drive shaft of the motors 26 have pinions 52 at the lower end. The pinions 52 are engaged with a ring gear 54, which is connected to the lower body 24. The pinions 52 and ring gear 54 transfer the rotary motion of the motors 26 to the lower body 24.

A cam track 138 is connected to the outer end of the trusses 128 and encircles the upper body 22. The cam track 138 is the means by which the upper and lower bodies 22, 24 are held together. Cam followers 140 are connected to the lower body 24 to fit into the cam track 138. In the prototype apparatus 20, the cam track 138 has a groove or channel which faces radially outwardly with respect to the vertical shaft 50. The cam followers 140 extend radially inwardly from their support post 142 to engage the cam track 138. As the lower body 24 rotates, the cam followers 140 roll around the cam track 138. In order to separate the upper and lower bodies 22, 24, the cam followers 140 are rotated horizontally out of the cam track 138 and then the two bodies 22, 24 are separated. The preferred cam track 138 is a continuous track, i.e., it is not made of removable sections. The continuous cam track 138 and rotatable cam followers 140 create a significant improvement in the drilling apparatus 20 by enabling more rapid assembly and disassembly of the upper and lower bodies 22, 24.

The cam followers 140 and cam track 138 are the main load path when the apparatus 20 is suspended by the riser connector 100 or lifting eyes 132 and when the apparatus 20 is drilling a hole. Therefore, the cam track 138 is continuously supporting either a suspended load or an upward thrust. It is therefore critical that the cam track 138 be smooth and true when installed on the upper body 22. Referring to the example of FIG. 2, in the prototype apparatus 20, alignment posts and sockets 144 are provided on the upper and lower bodies 22, 24 to facilitate alignment of the upper and lower bodies when they are being joined together. These posts and sockets 144 can be beveled and/or cooperatively funnel shaped to facilitate the proper alignment of the upper body and lower bodies 22, 24.

Referring to example FIG. 1, the lower body 24 has a lower body sleeve 150 which defines the lower body opening 42. The prototype lower body sleeve 150 has an upper extension 152 which extends inside the upper body sleeve 126 when the upper and lower bodies 22, 24 are joined together. The lower body sleeve 150 also stabilizes and aligns the lower body 24 with respect to the upper body 22, reduces lateral motion of the lower body 24 relative to the upper body 22, and transfers lateral force loadings to the upper body 22. A cylindrical bearing 154 is housed between the upper body sleeve 126 and the lower body sleeve 150 to reduce rotational friction between the upper body sleeve 126 and the lower body sleeve 150. The bearing 154 transfers any lateral or radial thrust of the lower body 24 to the upper body 22. The preferred bearing 154 is a bronze or similar bearing which is attached to the upper body sleeve 126.

Gusset plates 156 are welded to the outside of the lower body sleeve 150 to provide structural strength. The main structure of the lower body 24 extends radially from the lower body sleeve 150. In the prototype apparatus 20, referring to the example of FIG. 2, the main structure of the lower body 24 extends radially asymmetrically from the lower body sleeve 150, i.e., the lower body rotates about the axis of the shaft 50 which is the axis of the lower body sleeve 150 and the lower body 24 and the cutting mechanisms 28 extend asymmetrically radially about the axis of the shaft 50.

One embodiment has a lower body 24 with a diameter of 5 meters. The asymmetric radius allows a 6.2 meter hole to be excavated by the body 24. This asymmetric arrangement reduces weight, streamlines transportation requirements (boxing, cargo space, etc.), and provides other advantages of economy and logistics.

The lower side 46 of the lower body 24 is defined by the bottom plate, also designated 46. The prototype bottom plate 46 includes several plates which are separated by tee stiffeners. The bottom plate 46 angles upwardly and outwardly from the lower body sleeve 15. An acceptable range of angles of the bottom plate 46 with respect to the sleeve 150 is from 0 degrees to about 45 degrees. In the prototype apparatus 20, the bottom plate 46 has an angle of about 10 degrees, which offers a flatter bottom profile of the excavated hole.

The cutting mechanisms 28 are mounted in openings through the bottom plate 46 and are mounted from the inside of the lower body 24. Mounting the cutting mechanisms 28 from the inside of the lower body 24 permits replacement and maintenance of the discs without turning over the lower body 24 and without requiring access to the exterior side of the lower body 24 or bottom plate 46. It may be necessary to mount the innermost disc 28 on the outside of the bottom plate 46 because of dimensional and access limitations inside the lower body 24.

The cutting mechanism 28 can be any type and quantity of blade, disc, tooth, or other device which will cut the surface of the earthen formation and move the cuttings toward the casing 30. In the prototype apparatus 20, each cutting mechanisms 28 comprises a 2 meter diameter spherical disc mounted on a non-rotating shaft which is held in position by pillow block assemblies. Each disk 28 is welded to a bearing carrier assembly (not illustrated) which rotates on the non-rotating shaft. The discs 28 are sharpened on the peripheral edge facing away from the casing 30, i.e., they are sharpened on the non-cutting side of the edge, in order to promote wear such that the discs are self sharpening; also to provide a relief angle to the disc so that clay does not stick thereto.

In the prototype embodiment, there are 18 spherical disc assemblies 28 with fifteen assemblies mounted on the bottom plate 46 and three mounted on the outer periphery of the lower body 24 (best seen in FIG. 2). The cutting discs 28 are mounted at an angle skewed to the tangent of the circle of rotation of the disc 28. As the lower body 24 and disc 28 rotate, the cuttings are moved mechanically from the leading edge of the angled disc radially inward with respect to the lower body 24 until the cuttings leave the trailing edge of the cutting disk 28. The next cutting disc 28 then picks up the cuttings and transports them inwardly along with its own cuttings and so on until the cuttings reach the casing 30 and shaft 50. The tangential angle of the discs 28 can be adjusted to produce the best drilling results. In the prototype apparatus 20, the tangential angle of the discs 28 is 20 degrees.

The ring gear 54 is mounted on a base ring 158 which extends radially from the lower body sleeve 150. The base horizontal ring 158 of the ring gear 54 is welded onto another vertical ring 999. Ring 999 is then welded onto the plate 46 of the lower body. This stiffens the lower body plate 46, as well as offers support to the ring gear. The ring gear mount is a pipe approximately 4.2 meters in diameter with a flat "washer" approximately 4.2 meters in diameter and 255 millimeters wide welded onto the top of it. In the prototype apparatus 20, the ring gear 54 is as single piece ring gear which is bolted to the base plate with 36 bolts.

The cam followers 140 (which are used to allow the lower body to rotate relative to the upper body 22 and to fasten the upper and lower bodies 22, 24 together) are mounted in the lower body 24. The support post 142 for the cam follower 140 is welded onto the web of the tee section stiffeners for the bottom plate 46. As previously mentioned, the cam followers 140 are designed to pivot on their support posts 142 and thus to be pivoted out of the cam track 138. This feature allows the upper body 22 to be quickly separated from the lower body 24, which in turn allows quick access to the lower body 24, replacement of cutting discs 28 and/or repairs to either of the lower and upper bodies 22, 24. The alignment posts and sockets 144 are provided to reduce the time to mate the upper and lower bodies 22, 24 after separation for maintenance or field operations.

Figure 3:
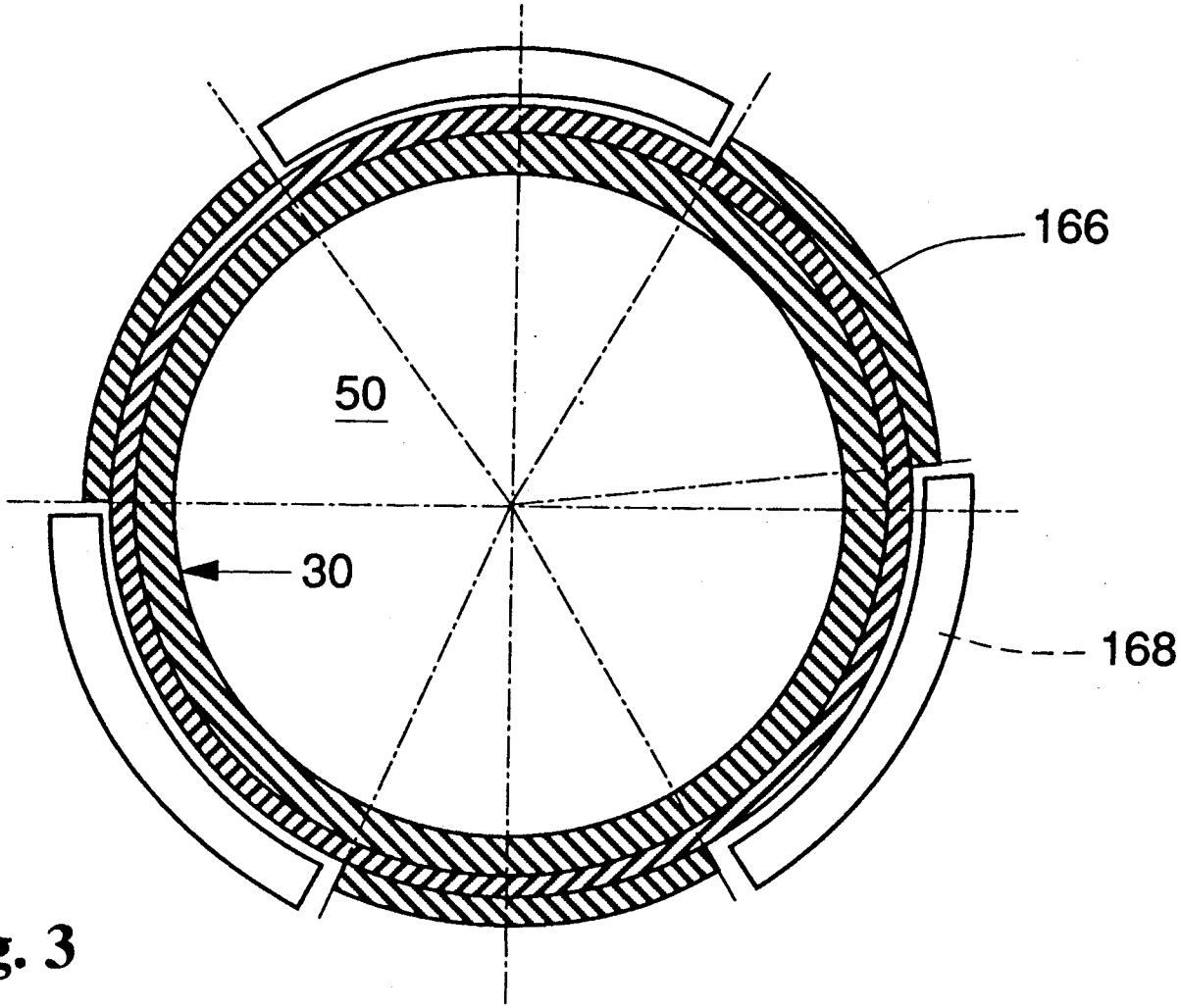
FIG. 3 is a sectional view of an embodiment of the casing 30 and engagement mechanisms 32 of the present invention taken along line 3—3 of FIG. 1.

Referring to the examples of FIGS. 1 and 3, the preferable engagement mechanisms 32 includes at least one lower body tooth 166, at least one casing tooth 168, and at least one shoulder 170. More preferably, there are at least three lower body teeth 166 and at least three casing teeth 168, although any number of interengaging teeth 166, 168 can be used. The lower body teeth 166 are connected to and extend inwardly from the inside surface of the lower body sleeve 150. The casing teeth are connected to and extend outwardly from the outside surface of the casing 30 in such a manner that the casing teeth 168 will engage the lower body teeth when the casing 30 is moved into the shaft from the upper side 38 of the upper body 22, i.e., the casing teeth 168 will interengage with the lower body teeth 166 as the casing is lowered into the shaft 50 as defined by the lower body sleeve 150. The teeth 166, 168 are designed to have sufficient strength to transfer the rotation of the lower body 24 to the casing 22 and to minimize the radial extension or radial dimension of the teeth 166, 168 in the shaft 50. This is particularly so with the lower body teeth 166, since the lower body teeth 166 remain in the shaft 50 when the casing 30 is removed and reduce the effective diameter of the shaft 50, i.e., the inward extension of the lower body teeth 166 partially obstructs the shaft 50.

The shoulder 170 is connected to and extends outwardly from the outside surface of the casing 30 on the side of the casing teeth 168 facing the upper end 60 of the casing 30 so that the shoulder 170 will limit downward travel of the casing 30 by contacting the lower body teeth 166 when the casing teeth 168 are interengaged with the lower body teeth 166. The shoulder 170 could be placed on the inside wall of the lower body sleeve 150 below the lower body teeth 166. In order to minimize the obstructions and protrusions from the inside walls of the lower body sleeve 150 (which affect access through the lower body sleeve 150), it is preferable that the shoulder 170 be mounted on the removable casing 30 as previously described. The lower body teeth 166 and casing teeth 168 can be replaced with other types of mechanical motion transfer systems, such as threaded connections, dented connections, ratcheted connections, etc. although the toothed connection is preferred.

In the prototype apparatus 20, the casing teeth 168 and shoulder 170 are located on the casing 30 between the upper casing lower end 74 and lower casing upper end 78. The positioning of the teeth 166, 168, and shoulder 170 affect the positioning of the casing 30 in the lower body sleeve 150 and the positioning of the rollers 106 with respect to the roller track 124. These positionings or tolerances are very important and they must be designed such that when the apparatus 20 is in operation and the lower body 24 is thrusting upward due to engagement with an ear then formation, the cam followers 140 will contact the upper part of the cam track 138 before the rollers 106 contact the roller track 124. In order for the cam followers 140 to engage the track 138 before the rollers 106 contact the roller track 124 the tolerance between the cam follower 140 and cam track 138, the tolerances between the rollers 106 and roller track 124, play in the cam followers 140 and rollers 106, as well as the positioning of the teeth 166, 168 and shoulder 170 must be considered. This is necessary so that the load path from the cutting discs 28 will be through the upper body sleeve 126 into the riser connector 100 and not through the cage 30 and rollers 106.

Figure 4:
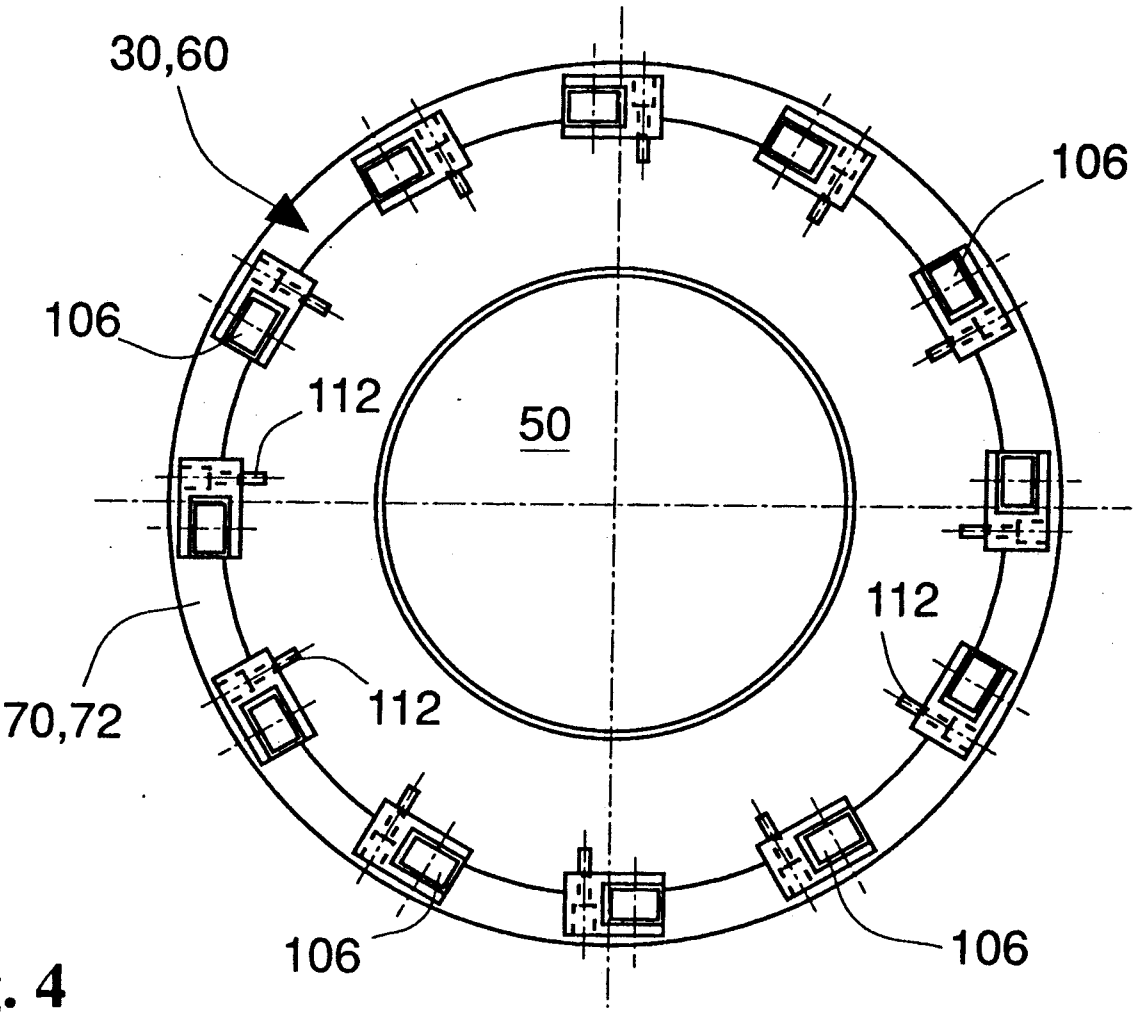
FIG. 4 is a top view of an embodiment of the casing of the present invention taken along line 4—4 of FIG. 1.

In the prototype apparatus 20, twelve yoke-mounted rollers 106 are mounted on the upper end 72 of upper casing 70, as exemplified in FIG. 4. The catch 112 of the prototype apparatus 20 is effected by a dog or protrusion, also designated 112 which protrudes radially inwardly from the roller 106 mounting. Referring to FIG. 1, the apparatus 20 is assembled so that the rollers 106 and catches 112 are above the riser connector lower flange 122. Therefore, if the riser connector 100 is disconnected from the upper body 22 and lifted, the casing 30 will be suspended from the lower flange 122 by the catches 112. This allows the casing 30 to be removed from the apparatus 20 by lifting the riser connector 100. Bearing collar 172 is provided at the upper casing upper end 72 to compensate for the separation between the casing 30 and the lower body sleeve 150 necessary to accommodate the engagement mechanism 32 and also to give lateral support at the upper casing upper end 72.

The removable casing 30 and engagements mechanism 32 are designed so that the casing 30 can be lifted with the riser connector 100 and from the apparatus 20 up through a rotary table or similar device on the floor of a drilling ship or drilling rig. The preferred apparatus 20, casing 30, and engagement mechanism 32 are sized so that, after removal of the casing 30, a 0.915 meter diameter drill bit will pass through the shaft 50. This allows the apparatus 20 to be positioned in the moonpool of a ship prior to arriving on location, which saves much time, e.g., the pilot hole of a well can be drilled, or a number of wells can be spudded, and a 0.915 meter hole (or smaller) for the surface casing of the well can be drilled through the shaft 50 without removing the entire apparatus 20 from the moonpool of the ship.

Also , the engagement mechanism 32 and lower body sleeve 150 are designed so that the casing 30 engages the lower body sleeve 150 and lower body 24 which causes the casing 30 to be rotated with the lower body 24 and therefore the auger 88 and drill bit 92 are rotated with the casing 30. This action enables the auger 88 and drill bit 92 to be used to stabilize the apparatus 20 or to drill a pilot hole. The prototype casing 30 has also been designed with a maximum outer diameter of 0.94 meters which allows the casing 30 to be withdrawn through the 0.952 meters internal diameter hole of a typical drill floor.

As previously mentioned, the riser connector 100 includes a passageway 114 of smaller diameter than the casing 30. In order to channel cuttings into the riser connector passageway 114 and to isolate the rollers 106 from the cuttings, a funnel shaped insert 174 is built into the inside of the casing 30. The funnel shaped insert 174 has a larger end connected to the inside surface of the casing 30 and smaller end extendable into the riser connector passageway 114 in order to direct the cuttings into the passageway. A radial plate or seal 176 can be connected between the upper end of insert 174 and the inside wall of the casing 30 to reinforce the upper end of the insert 174.

Figure 5:
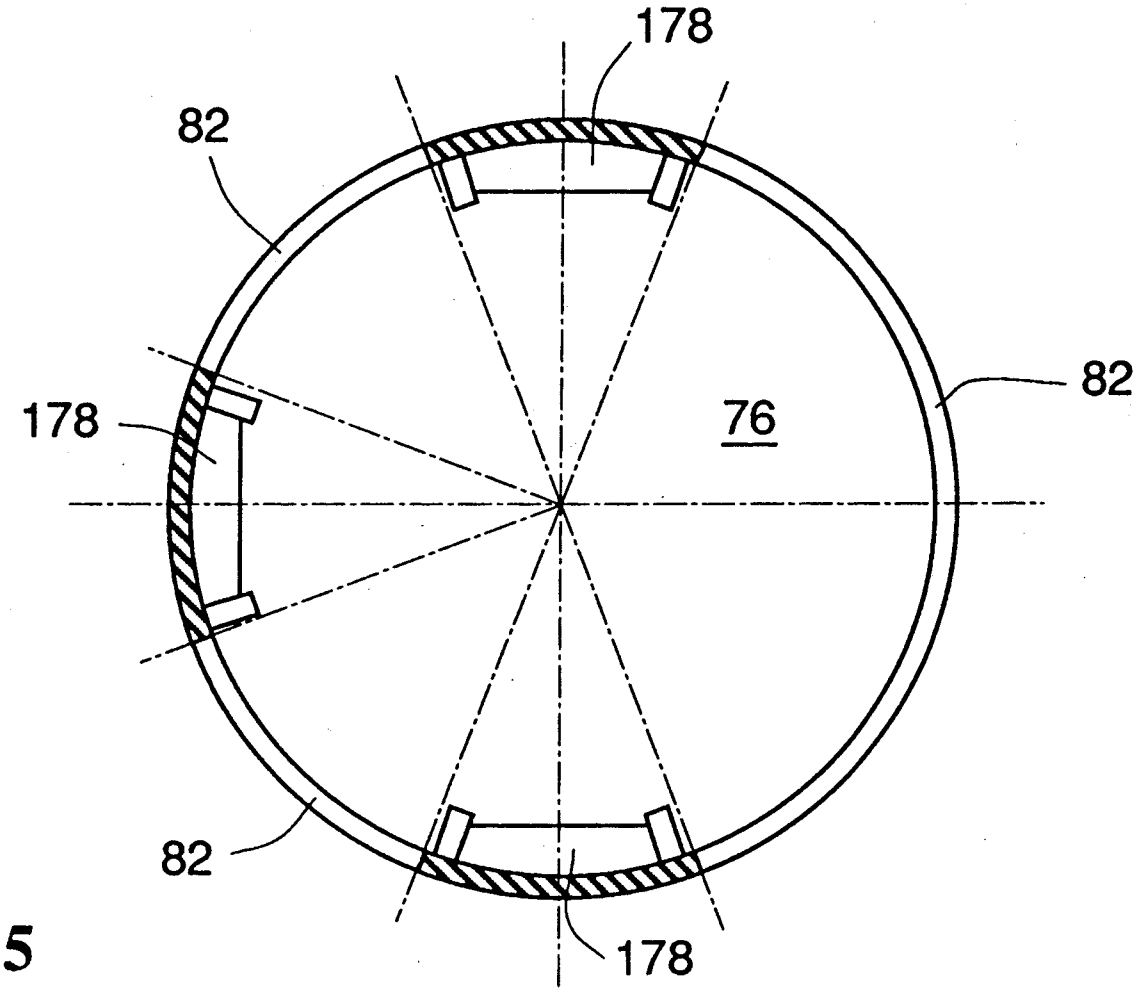
FIG. 5 is a sectional view of an embodiment of the lower casing 76 of the present invention taken along line 5—5 of FIG. 1.

Referring to FIGS. 1 and 5, the lower casing 76 of the prototype apparatus 20 is a 0.864 meters diameter pipe with three rectangular ports 82. The remaining portion of the lower casing, i.e., the portions between the ports 82, are reinforced with a ladder reinforcing 178 to strengthen the lower casing 76. In the prototype lower casing, the largest port 82 extends approximately 138 degrees around the circumference of the lower casing 76 in order to provide a port 82 which approximates the size of the cutting disc 28 (approximately 0.915 meters in diameter) and to thereby allow large chunks of debris cut by the discs 28 to enter the casing 30.

Just above the lower casing 76 a rock screen 180 is provided to prevent rocks or debris larger than the smallest annulus in the system from passing into and through the apparatus 20. As previously mentioned, these larger rocks and debris will fall into the receptacle 88.

As previously mentioned, the apparatus 20 includes disposal mechanism 64 for disposing of the cuttings carried through the casing 30. It is expected that the drilling apparatus 20 will normally be used with a conventional drilling rig, whether it be offshore or on dry land. The riser connector upper end 102 will be connected as a riser pipe 186. The riser pipe 186 forms a portion fo the disposal mechanism 64 as illustrated in FIG. 1. The disposal mechanism 64 includes the riser, a discharge deflector or tee, and a rubber hose. The "spoils" enter the center of the tool and are sucked up into the riser by the airlift system. The water stream in the riser carries the "spoils" or "cuttings" up the riser to the discharge tee. The tee has, in fact, the run blocked off so it, in fact, is a discharge hose assembly which directs the spoils over the side of the vessel.

The hose assembly includes a flange swivel elbow assembly connected to the hose. This flange is equipped with two long arms which extend perpendicular to the face of the flange. These arms have notches cut in them which fit over pins welded onto the discharge tee, thereby allowing the arms to catch on the pins and drop into the correct position on the discharge tee. The swivel assembly allows the 90 degree elbow to rotate thus preventing the hose from kinking as the hole is drilled.

A torque arrester system is provided to arrest the torque generated by the drilling apparatus 20. The torque arrester system comprises of a kelly bushing, torque arm, tieback system, and an 8½ inch square kelly. From the top down, this system comprises the kelly, the kelly bushing, the torque frame and the back lines, and the torque tubes attached to the riser. The kelly is a square tube with a circular center hole in it. The flats of the square tube are in contact with rollers in the kelly bushing such that the kelly can translate axially (vertically), as the hole is being drilled, but the rollers in the bushing resist the torque generated by the bit. Note that neither the kelly nor the kelly bushing or torque frame, nor the riser nor the upper body of the bit rotate. These are all static components which translate the torque generated by the rotating lower body 22 eventually to the kelly and torque frame.

The bottom of the kelly has a flange onto which is bolted the top flange of the discharge tee. Therefore, torque is transferred from the discharge tee to the kelly by the bolted flange arrangement. The kelly bushing is a component which holds the rollers which allow the kelly to translate axially. It, in turn, fits into the torque frame. The purpose of the torque frame is to reduce the force required to resist the torque (movement) by increasing the distance from the center of movement. The ends of the torque frame are connected to supports by means of a block and tackle arrangement which gives equal distribution of force to both "arms" of the torque frame. The torque frame includes a square center opening in which the kelly bushing rests, and two arms which are tied back to supports to resist the torque. Each of the riser pieces and the discharge tee is fitted with a "torque tube." This allows torque to be transmitted across the joints of the riser pipe. The toothed sections fit together thus transferring the torque across the riser joint. The torque is transferred up the riser to the kelly and then to the torque arm which is connected to the tieback posts. The kelly bushing allows the kelly to move vertically up and down while the torque is being transferred by means of rollers.

The fluid injection mechanism 66 is used for several purposes. It fluidizes the cuttings, keeps the area around the lower casing ports 82 clear, and reduces the potential for clogging; it is used to clean the drill bit 98; and it is used to undercut weak material on the sides of the hole created by the drilling apparatus 20 in order to reduce the possibility of the sides of the hole sloughing and also to increase the size of the hole beyond that created by the cutting disks 28.

The preferred fluid injection mechanism 66 is a water injection system, athough equivalent fluids can be used. Referring to the example of FIG. 2, in the prototype apparatus 20, high pressure water (5,000 psi design pressure) is pumped down two lines 188 attached to the riser pipe 186. The lines are tied together at a lower level and brought into the apparatus 20 in a single pipe 190, referring to the example of FIG. 1. After entering the apparatus 20, the pipe 190 passes through a swivel connection 192. The swivel connection 192 allows high pressure water to be piped to the rotating lower body 24 from a stationary upper body 22. After the swivel connection 192, a secondary pipe 194 is tied from the pipe 190 to deliver high pressure water to the lower body 24. The secondary pipe 194 is connected to the pipe 190 with a stab-type connection 196 to allow the casing 30 to be removed from the lower body sleeve 150. There is also a lower stab connection 198 to allow the auger 88 to be disconnected from the lower casing 76.

The secondary pipe 194 supplies high pressure water to three nozzles 200 on the periphery of the lower body and to three nozzles 202 on the bottom plate 46. The pipe 190 supplies high pressure water to one nozzle 204 aimed about 60 degrees upwardly in the auger cavity 94 and supplies high pressure water to the drill bit 98. The peripheral nozzles 200 are used to expand and stabilize the sides of the hole drilled by the apparatus 20. The bottom nozzles 202 and auger nozzle 204 are used to fluidize the cuttings. The water injected into the drill bit 98 is used to clean the drill bit as well as to fluidize the cuttings.

The mobile mechanism 68 is provided to assist in moving the fluidized cuttings up through the casing 30 and disposal means 64, and can comprise suction pumps or mechanical devices, such as screw conveyors or augers. The prototype mobile mechanism 68 is an airlift system which creates the suction required to move the fluidized by injecting air into the riser pipes 186 near the top of the apparatus 20. Injecting the air into the riser pipe 186 gives the fluidized cuttings in the riser pipe less density than the surrounding sea water and therefore the water flows up through the casing and riser pipe to the surface carrying the fluidized cutting with it. The mobile mechanism 68, or airlift, should maintain a sufficiently velocity of flow through the casing 30 to prevent clogging within the casing 30, as well as within the disposal mechanism 64. The prototype mobile mechanism 68 includes a section of drill pipe approximately 3 meters long with 40 12-millimeter diameter holes drilled radially through the pipe and one 39 millimeter hole in the bottom of a deflector plate. Air is pumped from the surface to the perforated pipe 68 and thereby into the riser pipe 186. Air is injected into the riser pipe at some distance, for example about 1 meter, above the top connection of the bit. The air is provided by air compressors connected to the top of the kelly. A specified length of drill pipe (depending on the water depth) called a "stinger" is screwed onto, i.e., below, the kelly. This stinger extends down inside the marine riser to a point about 1 to 2 meters above the top of the bit. The air is pumped down the kelly and stringer thereby injecting it into the marine riser. The air injection "head" at the end of the drill pipe stinger is a 10 ft length of drill pipe with 40 12-millimeter holes drilled into it radially. Also, the bottom end has a deflector plate welded onto the open end of the pipe which deflects the air sideways from the bottom opening. This does two things: it stops the hole from being plugged by cuttings, and it makes the air flow in a direction that does not go against the cuttings flow direction.

In order to prevent the holes in the pipe 68 from freezing as the air expands, and antifreeze manifold (not illustrated) can be used. The antifreeze manifold should allow antifreeze to be slowly added to the system at the surface. The prototype antifreeze system includes a tee section of a 100 millimeter pipe with appropriate valving to allow a reservoir of antifreeze to be slowly added to the air system. The antifreeze manifold is connected into the air system using hammer unions.

Baffle plates (not illustrated) are provided on the bottom side of bottom plate 46. In the prototype apparatus 20, the baffle plates include 15 millimeter plate welded square to the plane of the bottom plate 46. The baffle plates are curved on various radii in order to channel fluid flow into the lower casing 76 and port 82.

While presently preferred embodiments of the invention have been described herein for the purpose of disclosure, numerous changes in the construction and arrangement of parts and the performance of steps will suggest themselves to those skilled in the art, which changes are encompassed within the spirit of this invention as defined by the following claims.

What is claimed is:

1. A seafloor drilling apparatus for drilling a hole in the seafloor, comprising:

an upper body having an upper side, a lower side, and an opening extending vertically through the upper body from the upper side to the lower side;

a lower body, rotatably connected to the upper body, having an upper side, a lower side, and an opening extending vertically through the lower body from the upper side to the lower side in such a manner that the upper body and the lower body when connected each have the vertically extending openings aligned defining a continuous passageway through the upper and lower bodies rotator means for rotating the lower body relative to the upper body;

cutting means, connected to the lower body, for cutting seafloor material and moving the cuttings toward the lower body opening;

a casing, extending through the continuous passageway and having an upper end adjacent the upper side of the upper body and a lower end adjacent the lower side of the lower body, for receiving the cuttings from the cutting means and carrying the cuttings through the continuous passageway; a riser connector having an upper end and a lower end, the lower end being connected to the upper body so as to block the casing in the passageway; and engagement means for limiting downward travel of the casing in the passageway so that the casing is securable in a preselected position of downward travel and is removable from the passageway through the upper side of the upper body, and for engaging the casing with the lower body so that the casing is rotated with the lower body.

2. An apparatus of claim 1 wherein the riser connector comprises suspension means for suspending the casing from the riser connector.

3. An apparatus of claim 1 wherein the casing includes a lower receptacle for catching the cuttings which enter the lower casing and which are not transported out of the casing.

4. A apparatus of claim 3 wherein the receptacle comprises an auger having an upper end connected to the casing's lower end, a lower end, and an interior cavity open to the interior of the casing.

5. An apparatus of claim 4 including a drill bit connected to the lower end of the auger.

6. An apparatus of claim 1 wherein the lower body rotates about the axis of the passageway; and the lower body and the cutting means extend asymmetrically radially about the axis of the passageway.

7. An apparatus of claim 1 wherein the cutting means comprises a plurality of rotatable discs.

8. An apparatus of claim 1 and including disposal means for disposing of the cuttings carried through the casing; fluid injection means for fluidizing the cuttings; and mobile means for moving the fluidized cuttings through the casing and into the disposal means.

9. An apparatus of claim 8 wherein the disposal means comprises a riser, a discharge deflector operatively connected to the interior of an upper portion of the riser, and a hose outwardly extending from the deflector, whereby cuttings pass upwardly through the casing, riser, deflector, and are ejected from the hose.

10. An apparatus of claim 8 wherein the fluid injection means comprises means for providing pressurized liquid to one or more conduits interconnected within a riser within the shaft; and one of the conduits operatively connected to a plurality of openings in the lower body.

11. An apparatus of claim 8 wherein the mobile means comprises: means for providing pressurized air to the interior of a riser within the passageway.

* * * * *

UNITED STATES PATENT AND TRADEMARK OFFICE

CERTIFICATE OF CORRECTION

PATENT NO. : 5,035,291

DATED : July 30, 1991

INVENTOR(S) : Roger G. Shields

It is certified that error appears in the above--identified patent and that said Letters Patent is hereby corrected as shown below:

Column 1, line 65 "and" should read --an--.

Column 2, line 34 "for" should read --of--; and line 66 "an" should read --and--.

Column 4, line 8 after "casing 30" insert --and--; and line 38 "passeway" should read --passageway--.

Column 6, line 50 "15." should read --150.--.

Column 8, line 28 "walls" should read --wall--.

Column 12, line 2 after "12-millimeter" insert --diameter--.

Signed and Sealed this

Twenty-sixth Day of November, 1991

*Attest:*

HARRY F. MANBECK, JR.

*Attesting Officer*

*Commissioner of Patents and Trademarks*